US007138603B2

(12) United States Patent
Flagg et al.

(10) Patent No.: US 7,138,603 B2
(45) Date of Patent: Nov. 21, 2006

(54) DEVICE FOR REMOTELY DECOUPLING COUPLED OBJECTS WITH A FUSIBLE LINK UNDERWATER

(75) Inventors: Marco Flagg, Carmel Valley, CA (US); Andrew Eric Goldstein, Aptos, CA (US); Adam Paul Harvey, San Francisco, CA (US); Gregg Michael Holtmeier, Dublin, CA (US)

(73) Assignee: Desert Star Designs, LLC, Marina, CA (US)

( * ) Notice: Subject to any disclaimer, the term of this patent is extended or adjusted under 35 U.S.C. 154(b) by 128 days.

(21) Appl. No.: 10/772,420

(22) Filed: Feb. 6, 2004

(65) Prior Publication Data

US 2005/0051535 A1 Mar. 10, 2005

Related U.S. Application Data

(60) Provisional application No. 60/445,251, filed on Feb. 6, 2003.

(51) Int. Cl.
*H05B 1/02* (2006.01)

(52) U.S. Cl. ..... 219/201; 219/517; 441/2; 441/33

(58) Field of Classification Search ..... 219/494, 219/517, 519, 507, 509, 510, 511, 504, 505, 219/201, 202; 166/54, 5; 441/2, 33
See application file for complete search history.

(56) References Cited

U.S. PATENT DOCUMENTS

| | | | | |
|---|---|---|---|---|
| 1,167,481 | A * | 1/1916 | Copeland | 169/42 |
| 4,604,608 | A * | 8/1986 | Franchi | 340/540 |
| 6,491,062 | B1 | 12/2002 | Croft | |
| 2003/0070571 | A1 * | 4/2003 | Hodge et al. | 102/221 |

* cited by examiner

*Primary Examiner*—Mark Paschall
(74) *Attorney, Agent, or Firm*—McKenna Long & Aldridge LLP

(57) ABSTRACT

A device for remotely decoupling coupled objects with a fusible link underwater using a replaceable fusible link of appropriate electrical resistance, a method to supply a high-power charge of electricity across the fusible link, a mechanism held by the fusible link to hold and release a secondary link between the coupled objects and to add mechanical advantage to the strength of the fusible link, and a command-signal delivery system that enables remote activation of the device.

20 Claims, 1 Drawing Sheet

DEVICE FOR REMOTELY DECOUPLING COUPLED OBJECTS WITH A FUSIBLE LINK UNDERWATER

This application claims the benefit of U.S. Provisional Patent Application No. 60/445,251, filed on Feb. 6, 2003, which is hereby incorporated by reference for all purposes as if fully set forth herein.

BACKGROUND OF THE INVENTION

1. Field of the Invention

This invention relates generally to the field of underwater remote load releases and more specifically to a machine for remotely decoupling coupled objects with a fusible link underwater.

2. Discussion of the Related Art

Devices for decoupling coupled objects, here termed 'remote load releases', are used in many different environments and industries. Among these remote load releases, many in use today are underwater 'acoustic releases', so-called because they are triggered remotely by an acoustic signal transmitted through the water. These devices are commonly used for the anchoring of scientific instruments or other payloads to the seafloor until their retrieval is desired. When the command-signal is received by the acoustic releases they release their anchors and float to the surface. The underwater environment presents many unusual challenges for engineers who use acoustic releases, such as environmental degradation including for example biofouling (marine growth) and electrolytic corrosion, the heat sink characteristics of water, high pressures, etc . . . This has resulted in two basic types of acoustic release design predominating in the industry and the patenting of other designs which are not as commercially successful.

Many acoustic releases have a motor or solenoid driven release mechanism. These are here termed 'mechanical releases'. Typically, the motor or solenoid opens a gate or moves a piston, which then releases the load. Problems with this type of device include the bulk, cost, and frequent failure of the mechanism. When used in a marine environment, often environmental degradation such as marine organisms (biofouling) and electrolytic corrosion will jam the mechanism.

A second common type of acoustic release is frequently called a 'burn wire release.' This is actually a misnomer, because the device will not 'burn' a wire, but rather will corrode it slowly through electrolysis. A more accurate term for this is 'electrolytic release'. This is a cost effective solution. However, problems are slow corrosion time (several minutes), corrosion speed dependence on water salinity (it will not work well in fresh water), and biofouling that can act as an electrical insulator, thus preventing efficient corrosion. The release is also limited to light loads, because it is difficult to corrode a heavy wire.

A third type is the "Thermal Release Device" in U.S. Pat. No. 4,430,552, to Peterson, issued on Feb. 7, 1984. This device uses an embedded heating element to melt a synthetic rope link; the combination of these items is called a 'rope element'. Due to the slow rate at which the temperature of the heating element rises, this device requires insulation from the heat sink of the surrounding water. It also requires a DC to AC electricity converter (with its concomitant efficiency loss) to prevent premature corrosion of external electrical contacts. Another problem is that manufacturing time is relatively high for each rope element.

This Application discloses a thermal release device that does not require any such thermal insulation, and the heating element and the strength element are one and the same. As a consequence it is more simple, inexpensive, and effective.

SUMMARY OF THE INVENTION

An advantage of the invention is to provide a load release device that is less expensive and more reliable than done to date.

Another advantage of the invention is to provide a load release device that does not require thermal insulation from the environment.

Another advantage of the invention is to provide a load release device that is less affected by marine biofouling than done to date.

A further advantage of the invention is to provide a load release device that releases more rapidly upon activation.

Yet another advantage of the invention is to provide a load release device that is not affected by the salinity of surrounding water.

Still yet another advantage of the invention is to provide a load release device that works well with both light loads and heavy loads.

Another advantage of the invention is to provide a load release device that requires less battery power.

Other advantages of the present invention will become apparent from the following descriptions, taken in connection with the accompanying drawings, wherein, by way of illustration and example, an embodiment of the present invention is disclosed.

In accordance with an embodiment of the invention, there is disclosed a machine for remotely decoupling coupled objects with a fusible link underwater comprising: a replaceable fusible link with appropriate electrical resistance, a method to supply a very high-power charge of electricity across the fusible link, a mechanism held by the fusible link to hold and release a secondary link between the coupled objects and to add mechanical advantage to the strength of the fusible link, and a command-signal delivery system that enables remote activation of the device.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

Reference Numerals in Drawings

Replaceable fusible link

Electrical terminal with bolt head for attachment of fusible link

Capacitor-assisted Charge Delivery System comprising:

Battery

Capacitor charge circuit to control capacitor charging

Capacitor (energy reservoir)

Actuator switch

Command-signal from acoustic command receiver

Hinged lever for holding secondary link to coupled object

Guides for lever and containment of secondary link

Command-signal delivery system

Acoustic transducer for reception and transmission of acoustic signals in water

Secondary link to coupled object

Underwater housing

DETAILED DESCRIPTION OF THE ILLUSTRATED EMBODIMENTS

Detailed descriptions of embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
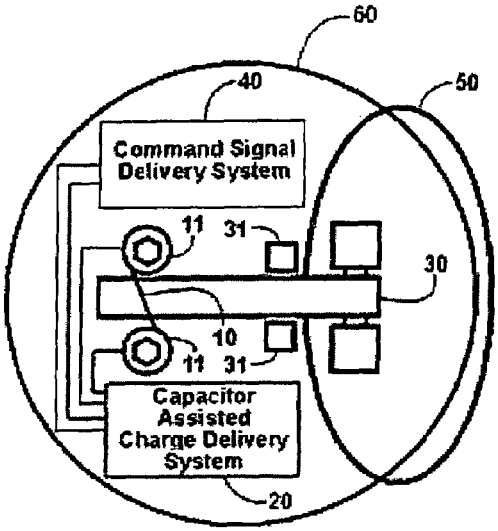
FIG. 1 is a bottom plan view of the invention.
Figure 2:
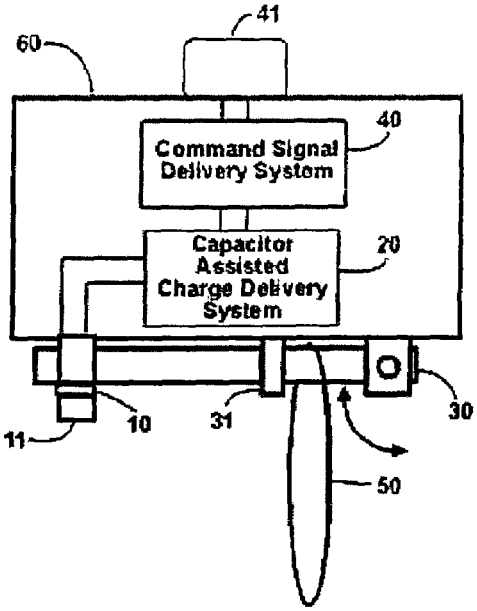
FIG. 2 is a side plan view of the invention.

An embodiment of the components of the present invention is illustrated in FIG. 1 (bottom view) and FIG. 2 (side view). The machine has a replaceable fusible link 10 attached to electrical terminals 11. In one embodiment of the present invention, there are two ¼" diameter, 1" long stainless steel posts. Both posts have a female thread in their top end, and an alien head screw is screwed into that thread. The fusible link 10 is wrapped one-half turn around the first post and then over to the second post and wrapped one-half turn around that second post. The allen head screws of each post are then tightened, thus securing (squeezing) the wire.

A command-signal delivery system 40 is electrically connected to the capacitor-assisted charge delivery system 20 which is electrically connected to the fusible link 10. A hinged lever arm 30 is held by this fusible link and, in turn, holds a secondary link 50 to a coupled object (not pictured). The hinged lever arm may be made of non-corrosive materials or low-friction materials which include self-lubricating materials. Examples of such materials would be metals such as stainless steel and titanium and plastics such as noryl®, nylon, PVC, and delrin®. Additionally, the friction areas of the lever arm may be minimized to reduce friction. Also, loose tolerances between the lever arm and its support may be used to prevent failure due to environmental degradation, for example biofouling. Further, while a hinged lever arm is shown in the present embodiment, any structure may be used in place of the lever arm that provides a release capability that provides a mechanical advantage.

In this embodiment the fusible link 10 is 26-gauge nickel chromium wire of the type commonly used for electric heater elements. It has a length of about 6 mm and an electrical resistance of approximately 8.86 Ohms per meter. However, the fusible link can be made of any material and gauge of sufficient strength and appropriate electrical resistance. The fusible link in this embodiment has a strength of about 18 kg and with the hinged lever arm 30 to add mechanical advantage the maximum load is increased to about 54 kg. The electrical terminals 11 are part of a circuit extending from the capacitor-assisted charge delivery system 20, described in the following paragraph.

Figure 3:
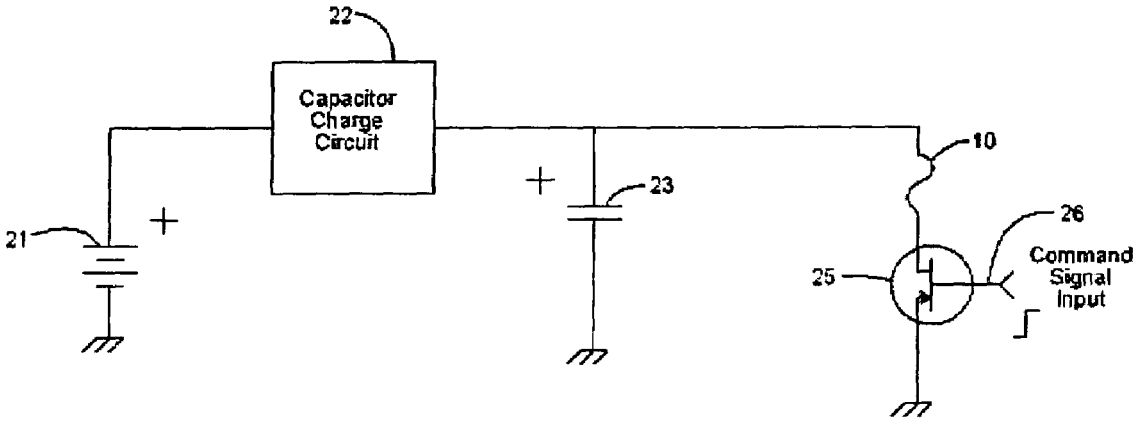
FIG. 3 is an electrical schematic of a capacitor-assisted charge delivery circuit embodied in the invention.

FIG. 3 is an electrical diagram of an embodiment of the method for supplying a high-power charge of electricity entitled a 'capacitor-assisted charge delivery system' 20. It includes a battery 21 connected to a capacitor charge circuit 22 to control capacitor charging, which is in turn connected to a capacitor or bank of capacitors 23 with low equivalent series resistance (ESR, also called internal impedance) ( about 0.018 Ohms) that act as a power reservoir. The power reservoir is three capacitors totaling about 100000 uF and charged to a voltage of about 30V. The capacitor(s) 23 are then connected to the fusible link 10 and the actuator switch 25. The actuator switch 25 receives the command-signal input 26.

In this embodiment the command-signal delivery system 40 is an acoustic signal reception and transmission system of the type commonly available from companies that sell underwater acoustic positioning systems, for example: Desert Star Systems. This command-signal delivery system 40 is connected to an acoustic transducer 41 through the underwater housing 60 for transmitting and receiving acoustic signals through the water.

When the command-signal delivery system 40 is remotely activated, it sends a command-signal 26 to the capacitor-assisted charge delivery system 20 which then delivers the electrical charge (at about 18000 Watts) to the fusible link 10. The fusible link 10 is thus violently melted, releasing the hinged lever arm 30 and decoupling the secondary link 50.

Within the capacitor-assisted charge delivery system, when the command-signal 26 is received from the command-signal delivery system 40, the actuator switch 25 closes to complete the circuit to ground, thus delivering the capacitor charge across the fusible link 10. This melts the fusible link in approximately 2 to 4 milliseconds, releasing the mechanism 20 which holds the secondary link 50 to the coupled object (not pictured).

This invention is based on the recognition of the fact that the temperature of the fusible link is determined by the balance of heat generation and heat dissipation. If heat generation is much faster than heat dissipation, then the wire temperature will rise rapidly and the wire will melt. Because water is an excellent heat sink, the rate of heat generation required for fusing to happen underwater without insulating the element is difficult to achieve with standard batteries of reasonable size, and due to their high internal resistance, these batteries cannot produce enough power. Therefore, the preferred embodiment of the invention uses capacitors with low impedance as an intermediate energy reservoir. Due to their low internal resistance, capacitors can deliver energy rapidly, that is at high power levels. The rapid delivery of energy easily overcomes the heat dissipating properties of water, and thus quickly heats the wire to the melting point. This has the added advantage that the required electric pulse is of very short duration, and therefore conserves battery reserves. For example, four standard AA alkaline batteries will provide approximately seventy release actions for a release mechanism designed for a holding power of 55 Kg.

Because there is only one moving part during a release action, a lever arm, the probability of failure due to fouling is much lower than in mechanical releases. The invention is also less expensive to manufacture than 'mechanical releases' because of the lower number of machined parts and its lack of a need for specialized underwater motors.

The invention releases its load faster than electrolytic releases, and its speed and effectiveness are not affected by the salinity of the water. It also is anticipated that it will work well with heavier loads than electrolytic releases can handle. This is because while heat dissipation rises only as a function of the wire diameter (surface area=2 $\pi rl$), the load bearing capacity of a wire is a function of the wire cross sectional area. The cross sectional area is $\pi r^2$. Thus, if wire diameter is doubled, heat dissipation is also doubled but load-handling capacity is increased by a factor of four. Doubling power generation will thus roughly quadruple load-handling capacity. Thus, this remote load release scales well to larger loads and actually becomes more efficient.

Increased buoyancy of the release load results in more reliable triggering of the release mechanism. Decreased buoyancy of the release load results in less stress on the wire. Therefore, the buoyancy of the release load may be selected to allow for reliable triggering of the release mechanism and at the same time to reduce stress on the wire.

In another embodiment of the present invention, the capacitor-assisted charge delivery system may be connected to a plurality of release mechanisms with a plurality of loads. Each release mechanism would have its own actuator switch 25 controlled by the command-signal delivery system 40.

Accordingly, the reader will see that this remote load release can be used to remotely decouple coupled objects with a fusible link underwater, can do this less expensively and more reliably than done to date, can do this without thermal insulation, is less affected by marine biofouling than existing systems, releases more rapidly than electrolytic release systems, is not affected by the salinity of surrounding water, works well with both light loads and heavy loads and will be more efficient with battery power than other methods.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for remotely decoupling coupled objects underwater comprising:

an uninsulated replaceable fusible link with an electrical resistance sufficient to cause heating and breaking of the uninsulated replaceable fusible link underwater;

a means for supplying a high-power electrical charge across the uninsulated replaceable fusible link sufficient to heat and break the uninsulated replaceable fusible link underwater;

a means, held by the uninsulated replaceable fusible link, for holding and releasing a secondary link between the coupled objects and for providing mechanical advantage to the strength of the uninsulated replaceable fusible link; and a command-signal delivery means that enables remote activation of the device.

2. The device of claim 1, wherein the uninsulated replaceable fusible link includes a length of nickel chromium wire attached to electrical terminals.

3. The device of claim 1, wherein the means for supplying the high-power electrical charge includes at least one capacitor with very low impedance.

4. The device of claim 1, wherein the means for supplying the high-power electrical charge includes:

a battery to charge at least one capacitor;

a capacitor charge control circuit electrically connected to the at least one capacitor;

an actuator switch to complete a circuit that includes the battery and the capacitor charge control circuit; and a control signal input to the actuator switch from a command-signal delivery system.

5. The device of claim 1, wherein the means for holding and releasing is a hinged lever.

6. The device of claim 1, wherein the command-signal delivery means includes a system for transmitting and receiving acoustic signals for remote activation of the device underwater.

7. The device of claim 1, wherein the means for holding is made of non-corrosive materials.

8. The device of claim 1, wherein the means for holding is made of low-friction materials.

9. The device of claim 1, wherein the means for holding is made of one of delrin plastic, PVC plastic, noryl plastic, nylon, titanium and stainless steel.

10. The device of claim 1, wherein the means for holding minimizes friction areas to minimize friction.

11. The device of claim 1, wherein the means for holding has loose tolerances between moving parts to prevent failure due to environmental degradation.

12. The device of claim 1, wherein one of the coupled objects is a floatation object wherein the buoyancy of the floatation object allows reliable decoupling of the coupled objects and reduces stress on the uninsulated replaceable fusible link.

13. The device of claim 1, further comprising a plurality of uninsulated replaceable fusible links and a plurality of means for holding and releasing a secondary link, wherein the means for supplying a high-power electrical charge is coupled to all of uninsulated replaceable fusible links.

14. A method of remotely decoupling couple objects underwater comprising:

storing a charge;

restraining a lever arm with an uninsulated replaceable fusible link;

linking a secondary link to the lever arm;

activating a switch to release the stored charge across the uninsulated replaceable fusible link to break the uninsulated replaceable fusible link underwater, wherein the stored charge is sufficient and is delivered at sufficient power to break the uninsulated replaceable fusible link.

15. The method of claim 14, wherein the charge is stored on a low resistance capacitor.

16. The method of claim 15, wherein a battery supplies the charge stored on the low resistance capacitor.

17. The method of claim 14, wherein activating a switch further comprises sending a signal command to a command signal delivery system to activate the switch.

18. The method of claim 17, wherein the signal command is an acoustic signal.

19. The method of claim 14, wherein the lever arm is made of non-corrosive materials.

20. The method of claim 14, wherein the lever arm is made of low friction materials.

* * * * *